US008387412B2

(12) United States Patent
O'Byrne

(10) Patent No.: US 8,387,412 B2
(45) Date of Patent: Mar. 5, 2013

(54) ARTICLE WITH INTERCHANGEABLE DECORATIVE ORNAMENTS

(76) Inventor: Christopher J. O'Byrne, Irvine, CA (US)

( * ) Notice: Subject to any disclaimer, the term of this patent is extended or adjusted under 35 U.S.C. 154(b) by 451 days.

(21) Appl. No.: 12/566,264

(22) Filed: Sep. 24, 2009

(65) Prior Publication Data

US 2010/0075073 A1 Mar. 25, 2010

Related U.S. Application Data

(60) Provisional application No. 61/099,691, filed on Sep. 24, 2008.

(51) Int. Cl.
*A44C 25/00* (2006.01)

(52) U.S. Cl. ..... 63/40; 24/303

(58) Field of Classification Search ..... 63/40; 24/303, 24/906, 113 R, 113 MP, 114.11, 114.12
See application file for complete search history.

(56) References Cited

U.S. PATENT DOCUMENTS

| | | | | |
|---|---|---|---|---|
| 2,659,169 | A | 11/1953 | Brennan | |
| 2,752,764 | A | 7/1956 | Lederer | |
| 2,793,415 | A * | 5/1957 | Respini | 24/100 |
| 4,060,185 | A * | 11/1977 | Kuroda | 224/176 |
| 4,660,992 | A | 4/1987 | Paul et al. | |
| 4,905,335 | A | 3/1990 | Tervola | |
| 4,912,944 | A | 4/1990 | Crosley et al. | |
| 4,982,581 | A | 1/1991 | Furuyama | |
| 5,195,336 | A | 3/1993 | Mershon | |
| 5,315,739 | A * | 5/1994 | Herman | 24/113 MP |
| 5,317,789 | A | 6/1994 | Levy | |
| 5,355,698 | A | 10/1994 | Edmark | |
| 5,535,603 | A | 7/1996 | Hayakawa | |
| 5,732,451 | A | 3/1998 | Mars | |
| 5,806,346 | A | 9/1998 | Schlinger et al. | |
| 5,921,110 | A | 7/1999 | Middendorff et al. | |
| 6,282,760 | B1 | 9/2001 | Mars | |
| 6,363,584 | B1 | 4/2002 | Gero et al. | |
| 6,427,487 | B1 * | 8/2002 | Morgan | 63/29.1 |
| 6,536,235 | B2 * | 3/2003 | Lovegrove | 63/15 |
| 6,548,128 | B2 * | 4/2003 | Auld et al. | 428/13 |
| 6,557,377 | B1 * | 5/2003 | Massari | 63/23 |
| 6,569,039 | B1 | 5/2003 | Cope | |
| 6,588,067 | B2 * | 7/2003 | Efron et al. | 24/102 SL |
| 6,594,871 | B2 | 7/2003 | Hoffman | |
| 6,729,159 | B2 | 5/2004 | Rose | |
| 7,201,021 | B2 | 4/2007 | Hartgrove | |
| 7,216,508 | B2 | 5/2007 | Kretchmer et al. | |
| 7,409,837 | B2 | 8/2008 | Smith | |
| 7,870,696 | B2 * | 1/2011 | Lin | 52/204.59 |
| 2002/0139142 | A1 | 10/2002 | Marandola, Jr. | |
| 2004/0093897 | A1 | 5/2004 | Weissbuch | |
| 2006/0032270 | A1 | 2/2006 | Doyno | |
| 2007/0051653 | A1 * | 3/2007 | Tilton | 206/462 |
| 2007/0117496 | A1 * | 5/2007 | Maron | 451/29 |
| 2007/0124898 | A1 | 6/2007 | Clark | |
| 2007/0241148 | A1 | 10/2007 | Strasser | |
| 2008/0263914 | A1 * | 10/2008 | Rosenbach | 40/1 |
| 2009/0016175 | A1 | 1/2009 | Anderson | |

* cited by examiner

*Primary Examiner* — Robert J Sandy
*Assistant Examiner* — Louis Mercado
(74) *Attorney, Agent, or Firm* — The Law Offices of Eric W. Peterson

(57) ABSTRACT

A jewelry article having one or more interchangeable inserts removably attached thereto. In an aspect, the article has an assembly having an opening and one or more recessed portions, wherein one or more interchangeable inserts are removably attached therein. The one or more inserts have a top portion having a recessed housing to house one or more decorative ornaments, and a base portion having one or more cavities wherein one or more magnets are adhesively affixed therein.

21 Claims, 3 Drawing Sheets

ARTICLE WITH INTERCHANGEABLE DECORATIVE ORNAMENTS

REFERENCE TO RELATED APPLICATION

This application claims benefit of U.S. Provisional Application No. 61/099,691, filed Sep. 24, 2008, the disclosure of which is incorporated by reference in its entirety.

BACKGROUND

1. Field of the Invention

The present invention relates generally to articles with interchangeable decorative ornaments. More particularly, in an aspect, the present invention relates to objects and methods of providing an article having one or more inserts removably attached thereto, wherein the one or more inserts comprise one or more decorative ornaments.

2. Background

Currently, jewelry articles are limited to a certain look and market and fail to provide a wearer with the ability to express his or her artistic style. This is particularly unfortunate as many individuals enjoy customizing their look according to the outfit they are wearing, or according to their style or artistic tastes. Therefore, aspects of the present invention provide an article having one or more inserts removably attached thereto, wherein the one or more inserts comprise one or more decorative ornaments.

SUMMARY

The following presents a simplified summary of the invention in order to provide an understanding of some aspects of the invention. This summary is not an extensive overview of the invention. Its sole purpose is to present some concepts of the invention in a simplified form as a prelude to the more detailed description that is presented later.

In an aspect, the present invention provides an article having one or more removable and interchangeable inserts. The article comprises a piece of material, a base plate, and a frame assembled for supporting and removably attaching thereto one or more inserts comprising one or more magnets and one or more decorative ornaments. The one or more inserts are removably secured to the material, base plate, and frame assembly to provide interchangeability of the decorative ornaments housed therein.

In another aspect, the article comprises a frame assembly for supporting and removably attaching thereto one or more interchangeable inserts comprising one or more magnets and one or more decorative ornaments. The one or more inserts are removably secured to the assembly to provide interchangeability of the decorative ornament affixed thereto. The frame assembly, in an aspect, is a unit comprising a base portion and frame portion.

Other aspects, advantages, and certain illustrative aspects and novel features of the invention are described herein in connection with the following detailed description and the accompanying drawings, and in part will become apparent to those skilled in the art upon examination of the following, or can be learned by practice of the invention. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

In addition, while a particular feature of the invention may have been disclosed with respect to only one of several implementations, such feature may be combined with one or more other features of the other implementations as may be desired and advantageous for any given or particular application.

BRIEF DESCRIPTION OF THE DRAWING FIGURES

DETAILED DESCRIPTION

Figure 1:
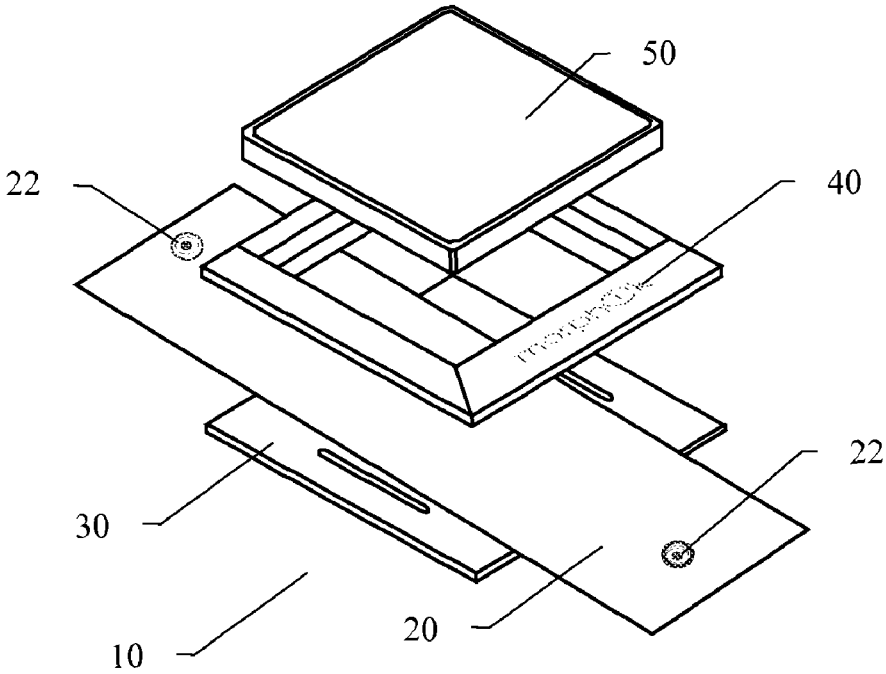
FIG. 1 illustrates a perspective view of an article with interchangeable decorative ornaments in accordance with an aspect of the invention.

The forgoing as well as other aspects and advantages of the invention will become apparent from the following detailed description when considered in conjunction with the accompanying drawings and other material, wherein like reference characters designate like parts throughout the several views. In the following description, for purposes of explanation, numerous specific details are set forth in order to provide a thorough understanding of the subject invention. It may be evident, however, that the invention can be practiced without these specific details. It should also be appreciated that although specific examples presented may describe or depict certain aspects of the subject invention, the invention is not limited to those aspects. Those of ordinary skill in the art will readily recognize that the disclosed invention can be used for other purposes and in other manners other than those described.

Reference to a particular numerical value includes at least that particular value. Ranges may be expressed herein as "from," "about," "near," or "approximately" to another particular value. When such a range is expressed, alternative embodiments include at least from the expressed range value to the other particular value Similarly, values that are expressed as approximations, by use of the other antecedent "about," "approximately," "slightly," "at least" or "near" will be understood that the particular value forms another embodiment and the variations thereof form additional embodiments.

As used herein, the term "jewelry" refers to, but is not limited to, any type or style of object which may be worn as either ornamentation or for a functional purpose. Furthermore, the articles described herein are not limited to being worn on humans. Aspects of the present invention can be utilized on other various beings. For example, aspects of the present invention can be used by canines and felines. Furthermore, aspects of the present invention can be utilized in a manner wherein the article is not worn; rather the article is used as a display piece or other type of decoration.

Turning to the drawings, FIG. 1 illustrates an embodiment in accordance with an aspect of the invention. An article represented generally at 10 is provided, wherein article 10 is illustrated as a bracelet. It is to be understood that alternative embodiments of the present invention are envisioned. For example, article 10 can be any jewelry article, wearable article, adornment, broach, belt buckle, pendant, necklace, wrist-band, watch, ring, earring, decoration or any other object wherein the spirit of the invention is followed.

Article 10 comprises a piece of material 20, base plate 30, frame 40, and insert 50. Material 20 can comprise leather, snakeskin, cloth, cotton, felt, nylon, polyester, rope, cord or any other fabric, synthetic, alloy or other material or combination thereof. In addition, material 20 can have a width and length sized according to the intended use of article 10. For example, in an aspect, a wearable article can be provided wherein material 20 can comprise a length equal to, or greater than, the circumference of a user's wrist, ankle, or neck and can have one or more attachment means on at least one end. The one or more attachment means can comprise at least one or more of one or more buttons, clasps, snaps, magnets, clips or other known means of attachment.

Base plate 30 and frame 40 are assembled by compressing base plate 30 and frame 40 together with material 20 there between. In an alternative embodiment, base plate 30 and frame 40 can be assembled using other methods of attachment. For example, an adhesive, one or more magnets, or one or more securing articles or agents can be utilized to secure base plate 30 and frame 40 to one another. Insert 50 is removably attached and housed within the material 20, base plate 30, and frame 40 assembly by way of magnetic attraction between the base plate 30 and the one or more magnets 53 housed within insert 50. In addition, magnetic attraction between the one or more magnets 53 housed within insert 50 can be accomplished with frame 40.

In an aspect, base plate 30 and frame 40 can comprise one assembly unit, wherein insert 50 is removably attached and housed therein. For example, the base plate 30 and frame 40 can be cast into a frame assembly, thereby providing an assembly unit for insert 50 to be removably attached thereto. The assembly can have one or more recessed portions therein to provide housing for base portion 56 and top portion 59 of insert 50. The assembly can have an opening comparable to opening 31 to provide access to a user to interchange insert 50. The element can have one or more attachment means affixed thereto. For example a pin assembly, one or more magnets, buttons, clasps, snaps, clips, hanging unit, wall mount, or a prop assembly can be provided to allow affixation of the assembly to a user's shirt, coat or other item or to provide a user with the ability to display the assembly on a mantle or wall. It is to be understood that various aspects of the invention as described herein will apply to this embodiment.

Figure 2:
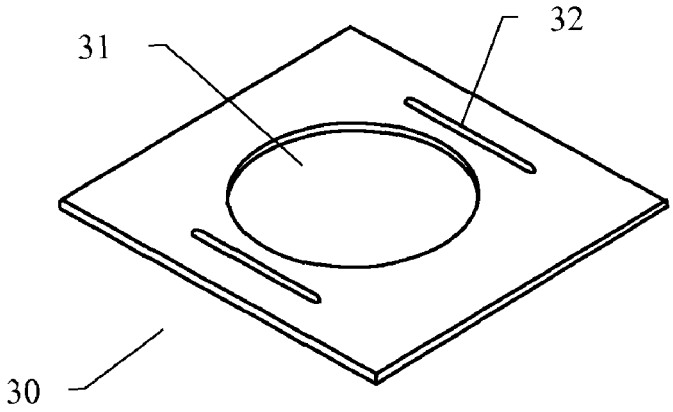
FIG. 2 illustrates a base plate in accordance with an aspect of the invention.

FIG. 2 illustrates a base plate represented generally at 30 in accordance with an aspect of the invention. Base plate 30 comprises opening 31 and one or more slots 32. Opening 31 is circular in nature and located at or near the center of base plate 30. Opening 31 is at least large enough to allow an individual to introduce his or her finger, or a dislodging apparatus, through opening 31 to remove insert 50 when the article is assembled and insert 50 is removably attached thereto. In addition, while opening 31 is illustrated as circular in nature, it is to be noted that any geometric shape can be utilized. For example, opening 31 can be circular, square, rectangular, triangular or any other shape wherein a user can remove insert 50.

In an aspect, the one or more slots 32 are positioned to be aligned with one or more protrusions 44 of frame 40 when base plate 30 and frame 40 are assembled. The one or more slots 32 are sized to be smaller than the one or more protrusions 44 of frame 40 to secure the base plate 30 and frame 40 to one another when compression forces are applied. In another aspect, the one or more slots 32 are sized to be larger than the one or more protrusions 44 of frame 40 to secure the base plate 30 and frame 40 to one another when compression forces are applied. Other methods of compression assembly are envisioned. For example, the one or more slots 32 can be misaligned from the one or more protrusions 44 whereby when compression forces are applied, the one or more protrusions 44 can conform to the position of the one or more slots 32 providing attachment of frame 40 to base plate 30.

While the one or more slots 32 are illustrated as linear in nature, it is envisioned that the one or more slots 32 can be any geometrical shape and size wherein attachment to the one or more protrusions 44 of frame 40 can be accomplished. The one or more slots 32 have a depth that is less than the total thickness of plate 30. In addition, the one or more slots 32 have a depth that provides an adequate thickness between the bottom of the one or more slots 32 and the bottom of base plate 30 to assure that when the one or more protrusions 44 of frame 40 are compressed therein, the bottom of the one or more slots 32 does not fail and allow the one or more protrusions 44 to puncture therethrough. In an alternative embodiment, the one or more slots 32 can have a depth equal to the thickness of base plate 30 providing one or more openings (not shown) for the one or more protrusions 44 to extend therethrough and be secured on the bottom side of base plate 30 by bending the one or more protrusions 44 in place or affixing them by some other known method. Furthermore, in an aspect, base plate 30 is at least a thickness that provides enough ferromagnetic material to attract the one or more magnets housed within insert 50.

Figure 3:
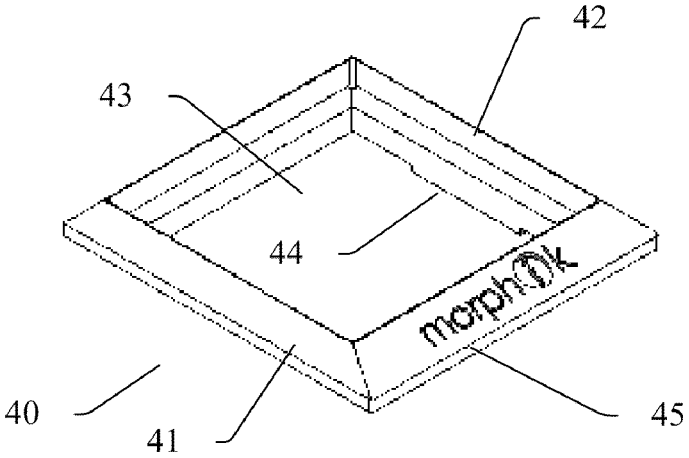
FIG. 3 illustrates a frame in accordance with an aspect of the invention.
Figure 4:
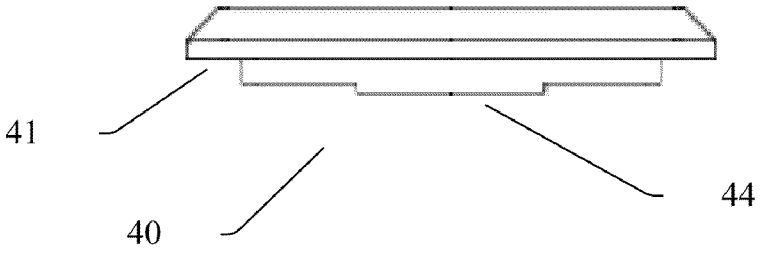
FIG. 4 illustrates a side view of a frame in accordance with an aspect of the invention.

FIGS. 3 and 4 illustrate a frame represented generally at 40 in accordance with an aspect of the invention. Frame 40 comprises one or more extensions 41, recessed portion 42, opening 43, and one or more protrusions 44.

In an aspect, the one or more extensions 41 extend outwardly from recessed portion 42 to provide rigidity to the article when assembled with material 20 and base plate 30. The distance the one or more extensions 41 extend from recessed portion 42 provides surface area to be compressed onto material 20, thereby preventing movement of the material with respect to the base plate and frame, and creating a rigid assembly when frame 40 is attached to base plate 30. In an embodiment, three extensions extend outwardly from recessed portion 42 at distances equal to one another, while the fourth extension is equal to double the width of one of the other extensions. It is to be understood that other embodiments are envisioned and can be utilized, provided the spirit of the invention is followed. For example, the one or more extensions 41 can extend equally from recessed portion 42.

Recessed portion 42 is provided to house top portion 59 of insert 50. Recessed portion 42 can have a depth equal to, greater than or less than the thickness of top portion 59 of insert 50. Furthermore, the length and width of recessed portion can vary according to the dimensions of insert 50. In an embodiment, adequate clearance can be provided by recessed portion 42 so that top portion 59 of insert 50 can be housed therein and be restricted in movement and given enough clearance to be easily inserted, removed and interchanged by a user.

Opening 43 is provided to house base portion 56 of insert 50 therein. The dimensions of opening 43 can vary according to the dimensions of base portion 56. In an aspect, the dimensions are slightly larger than the dimensions of base portion 56 to provide adequate clearance and to restrict the movement of insert 50 when housed therein. Furthermore, the depth of opening 43 can be exactly or slightly larger than base portion 56 of insert 50. In an embodiment, by providing a depth of opening 43 exactly or slightly larger than the base portion 56 of insert 50, the magnetic forces of the one or more magnets 53 housed in insert 50 will have a greater impact on base plate 30 and frame 40 providing adequate attraction thereto.

One or more protrusions 44 are provided at the base of the opening 43 and provide a method of attaching frame 40 with base plate 30. The one or more protrusions 44 extend downwardly from the bottom of opening 43 and extend at most a length equal to or less than the depth of the one or more slots 32 on base plate 30. Alternatively, the one or more protrusions 44 can have a length greater than the depth of the one or more slots 32 on base plate 30, thereby providing an alternative method of attachment thereto.

In various aspects, frame 40 can have design elements included thereon. For example, a trademark such as "MORPHIK" can be placed thereon. In addition, frame 40 can comprise chamfer 45. Furthermore, extensions 41 can be angular in shape. Various physical embodiments are envisioned as within the scope of the invention.

Figure 5:
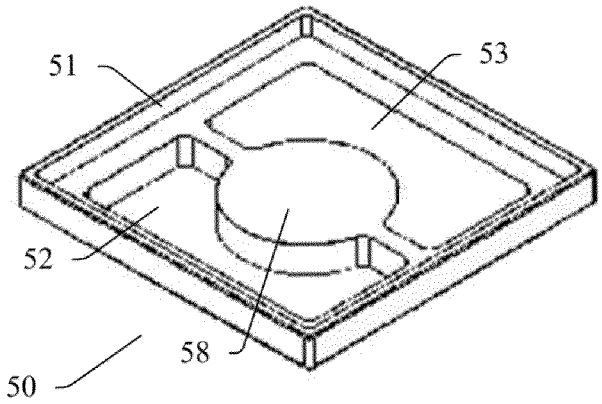
FIG. 5 illustrates an insert in accordance with an aspect of the invention.
Figure 6:
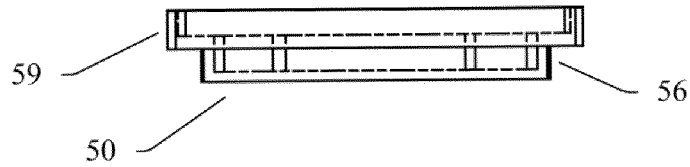
FIG. 6 illustrates a side view of an insert in accordance with an aspect of the invention.
Figure 7:
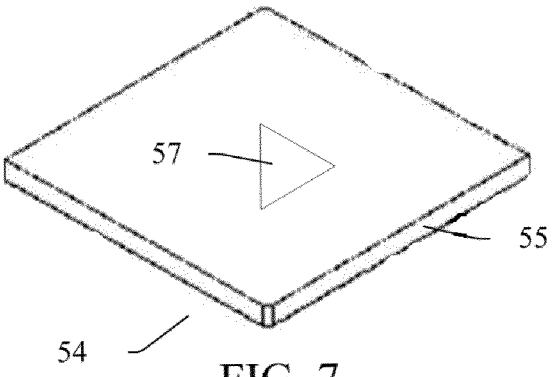
FIG. 7 illustrates a decorative ornament in accordance with an aspect of the invention.

FIGS. 5, 6 and 7 illustrate an insert represented generally at 50 in accordance with an aspect of the invention. Insert 50 comprises top portion 59 with recessed housing 51 therein, base portion 56 with one or more cavities 52 therein, one or more magnets 53, and one or more decorative ornaments 54.

Recessed housing 51 is provided within top portion 59. Recessed housing 51 is dimensioned to accommodate the one or more decorative ornaments 54 and one or more adhesives. Recessed housing 51 has a depth at least equal to the sum of the thickness of the one or more decorative ornaments 54 and the thickness of any securing agent such as glue, epoxy or double-sided tape. It is to be understood that recessed housing 51 can have a depth greater than or less than the sum of the one or more decorative ornaments 54 and any securing agent.

One or more cavities 52 are provided within base portion 56, wherein base portion 56 has a depth slightly larger than the depth of the one or more cavities 52. The one or more cavities 52 have dimensions that are equal to the proportion of the one or more magnets 53 housed therein. Alternatively, the dimensions of the one or more cavities 52 can be greater than, equal to, or less than the dimensions of the one or more magnets 53 housed therein. The one or more magnets 53 are adhesively affixed to insert 50 within the one or more cavities 52 via one or more securing agents. In another aspect, the one or more magnets 53 can be affixed through another method of attachment. For example, through magnetic attraction. In addition, while half-moon shaped magnets have been illustrated, other geometric shapes are envisioned as being within the scope of the invention. For example, one or more square magnets can be secured within one or more square cavities provided within base portion 56 of insert 50.

Furthermore, while a circular shape has been illustrated at or near the center portion 58 of insert 50, it is to be understood that any shape can be utilized. For example, to accomplish the greatest magnitude of magnetic attraction between the one or more magnets 53 housed within insert 50 and base plate 30, the one or more magnets 53 housed in insert 50 can be shaped corresponding to the dimensions of base plate 30, thereby adapting the shape of the center portion 58 of insert 50 to match that of opening 31 of base plate 30. Furthermore, the surface area provided at center portion 58 provides an area wherein the one or more decorative ornaments 54 can at least be adhesively affixed.

In an embodiment, the magnetic attraction between the one or more magnets 53 housed within insert 50 and the base plate 30 and frame 40 assembly prevents accidental disengagement of the insert from the assembly during use. When the wearer wishes to remove and/or replace the insert from engagement with the base plate 30 and frame 40 assembly, he or she apples a force through opening 31 sufficient to break the magnetic bond between the one or more magnets 53 and the base plate 30 and frame 40 assembly.

The one or more decorative ornaments are represented generally at 54 and comprise a piece of transparent thermoplastic 55, one or more adhesives (not shown), and a work of authorship 57. The decorative ornament 54 is housed within recessed housing 51 and is adhesively affixed therein via one or more adhesives or other means of attachment. The transparent thermoplastic 55 has a work of authorship 57 affixed thereto via one or more adhesives. In an alternative embodiment, the work of authorship 57 can be printed directly on the transparent thermoplastic 55. For example, one or more of at least a cold press or hot press method can be utilized to produce and/or transfer the one or more works of authorship 57 to the transparent thermoplastic 55. The transparent thermoplastic 55 is precut to the fit the shape of the insert 50 being assembled and the work of authorship 57 being affixed thereto. In an alternative embodiment, the transparent thermoplastic 55 can be precut in various shapes and sizes to allow more than one decorative ornament 54 to be housed in recessed housing 51. It is to be understood that one or more decorative ornaments 54 can be housed within insert 50. In an aspect, the one or more decorative ornaments 54 can be interchangeable within insert 50.

In an embodiment, the one or more decorative ornaments 54 can comprise a metallic chip with one or more works of authorship affixed or printed directly thereon. In this aspect, the one or more decorative ornaments 54 can be interchangeable within insert 50. For example, the metallic chip can comprise more than one piece with one or more works of authorship thereon and can be affixed to insert 50 via magnetic attraction, thereby providing a means for interchangeability. In addition, the metal chip can have a protected cover thereon. In an embodiment, the protective cover can be a coating of lacquer or other protective coating material.

In an alternative embodiment, insert 50 can comprise of more than one piece. For example, insert 50 can be split in half, quarters, or some other division, providing a user with the ability to interchange various sections of the one or more inserts 50 within frame 40.

It is to be understood that various alternative embodiments are envisioned as being within the scope of the invention. For example, various dimensions are envisioned, as well as various design concepts. For example, base plate 30, frame 40, and the one or more inserts 50 and all other components therein can comprise any geometric shape. For example, the assembly can be circular, square, rectangular or any other shape wherein the spirit of the invention is followed.

With respect to the one or more magnets described herein, it is to be understood that various alternative magnets, permanent magnets, or other ferromagnetic materials with various shapes, sizes, surface coatings and strengths can be employed as being in accordance with aspects of the invention. For example, a permanent magnet, such as a neodymium magnet can be used with the magnetic orientation through the thickness of the magnet. Furthermore, different rare-earth compounds with greater magnetic strength and equal or lesser costs can be utilized.

In addition, while the one or more decorative ornaments 54 have been described herein as including a transparent thermoplastic 55, it is envisioned that various other materials can be utilized. For example, a Plexiglas, polymer, glass, polyvinyl chloride, or other material can be utilized. Furthermore, while one or more adhesives have been described, it is envisioned that any substance with adhesive properties can be utilized. For example, double sided tape, glue, paste, epoxy, resin, a bonding agent, or any other product is envisioned as being within the scope of the invention.

Furthermore, it is to be understood that in an aspect some elements described herein can be made of various materials such as metals, papers, synthetics or other materials. For example, base plate 30, frame 40, and insert 50, and the various components therein, can be made of a stainless steel, steel, plastic, polymer, gold, silver, aluminum, a precious metal, or any other alloy or composition of matter that is consistent with the spirit of the invention. In addition, base plate 30, frame 40, and insert 50 can have one or more protective coatings thereon. For example, base plate 30 can be made of stainless steel and have plating thereon such as nickel, gold, silver or copper. In addition, the one or more elements described herein can comprise any color in the spectrum.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the invention are possible. Accordingly, the disclosed subject matter is intended to embrace all such alterations, modifications and variations that fall within the spirit and scope of the appended claims. Furthermore, to the extent that the term "includes," "has" or "having" or variations in the form thereof are used in either the detailed description or the claims, such terms are intended to be inclusive in a manner similar to the term "comprising" as "comprising" is interpreted when employed as a transitional word in a claim.

What is claimed is:

1. An article with interchangeable decorative ornaments, comprising:

a base plate comprising an opening and one or more slots;

a frame comprising a recessed portion, an opening, and one or more protrusions extending downwardly;

a means for joining said base plate and frame; and an insert comprising a top portion having a recessed housing, and a base portion having one or more cavities, wherein one or more magnets are affixed within said one or more cavities, wherein one or more decorative ornaments are affixed within said recessed housing, wherein the insert is housed within the frame, and wherein a piece of material is compressed between said base plate and frame thereby preventing movement of the material with respect to the base plate and frame.

2. The article of claim 1, further comprising an attachment means on at least one end of the piece of material.

3. The article of claim 2, wherein the base plate and the frame are joined by compressing said one or more protrusions within said one or more slots.

4. The article of claim 3, wherein the one or more decorative ornaments comprise at least a transparent thermoplastic and a work of authorship.

5. The article of claim 4, wherein the work of authorship is printed directly on the transparent thermoplastic.

6. The article of claim 4, wherein the work of authorship is affixed to the transparent thermoplastic by double-sided tape.

7. The article of claim 6, wherein the one or more decorative ornaments are adhesively affixed to the insert by at least one or more of glue or double-sided tape.

8. The article of claim 7, wherein the base plate, frame and insert are made of at least one or more of an alloy, stainless steel, aluminum and precious metal.

9. The article of claim 8, wherein the one or more magnets are neodymium magnets.

10. The article of claim 9, wherein the frame further comprises one or more extensions extending outwardly from the recessed portion.

11. A method of producing an article with interchangeable decorative ornaments, said method comprising a step of:

compressing a piece of material between a base plate and a frame thereby preventing movement of the material with respect to the base plate and frame, wherein the base plate comprises an opening and one or more slots, wherein the frame comprises a recessed portion, an opening and one or more protrusions extending downwardly from a base of said frame, and wherein the one or more protrusions are to be received within one or more slots on base plate.

12. The method of claim 11, further comprising removably attaching an insert to said article, wherein the insert comprises a top portion having a recessed housing, and a base portion having one or more cavities.

13. The method of claim 12, further comprising adhesively affixing one or more magnets within the one or more cavities.

14. The method of claim 13, further comprising adhesively affixing one or more decorative ornaments within recessed housing.

15. The method of claim 14, wherein the one or more decorative ornaments comprise a transparent thermoplastic and one or more works of authorship, wherein the one or more works of authorship are affixed to the transparent thermoplastic by at least one or more an epoxy, double-sided tape or glue.

16. An article with interchangeable decorative ornaments, comprising:

an assembly comprising an opening and one or more recessed portions; and an insert comprising a top portion having a recessed housing, and a base portion having one or more cavities, wherein one or more magnets are magnetically affixed within said one or more cavities, wherein one or more decorative ornaments are adhesively affixed within said recessed housing, and wherein the insert is removably attached within the one or more recessed portions.

17. The article of claim 16, wherein the one or more decorative ornaments comprise transparent thermoplastic, a work of authorship, and one or more adhesives.

18. The article of claim 17, wherein the work of authorship is affixed to the transparent thermoplastic via double-sided tape.

19. The article of claim 18, further comprising a means for attaching said article to a user.

20. An article with an interchangeable decorative ornament, comprising:

an insert comprising a top portion having a recessed housing, and a base portion having a cavity, and a magnet, wherein the magnet is magnetically affixed within the cavity and wherein the decorative ornament is adhesively affixed within the recessed housing.

21. The article of claim 20 wherein the decorative ornament comprises transparent thermoplastic.

* * * * *